US012419428B2

(12) United States Patent
Cohen

(10) Patent No.: US 12,419,428 B2
(45) Date of Patent: Sep. 23, 2025

(54) FOLDABLE WALL BED/SOFA

(71) Applicant: Oren Cohen, Ramat Gan (IL)

(72) Inventor: Oren Cohen, Ramat Gan (IL)

( * ) Notice: Subject to any disclaimer, the term of this patent is extended or adjusted under 35 U.S.C. 154(b) by 883 days.

(21) Appl. No.: 16/962,695

(22) PCT Filed: Jan. 16, 2019

(86) PCT No.: PCT/IL2019/050063
§ 371 (c)(1),
(2) Date: Jul. 16, 2020

(87) PCT Pub. No.: WO2019/142186
PCT Pub. Date: Jul. 25, 2019

(65) Prior Publication Data

US 2020/0367658 A1 Nov. 26, 2020

Related U.S. Application Data

(60) Provisional application No. 62/618,088, filed on Jan. 17, 2018.

(51) Int. Cl.
*A47C 17/40* (2006.01)
*A47C 17/20* (2006.01)
*A47C 17/38* (2006.01)

(52) U.S. Cl.
CPC ..... *A47C 17/20* (2013.01); *A47C 17/38* (2013.01)

(58) Field of Classification Search
CPC ..... A47C 17/38; A47C 17/40; A47C 17/42; A47C 17/44; A47C 17/46; A47C 17/48; A47C 17/50
See application file for complete search history.

(56) References Cited

U.S. PATENT DOCUMENTS 1,059,497 A * 4/1913 Smith ..... A47C 17/40 5/178
1,875,456 A * 9/1932 Heerdt ..... A47C 17/42 5/139

(Continued)

FOREIGN PATENT DOCUMENTS

AT 508352 A4 1/2011
EP 2801294 A1 11/2014

*Primary Examiner* — Justin C Mikowski
*Assistant Examiner* — Ifeolu A Adeboyejo
(74) *Attorney, Agent, or Firm* — FISHERBROYLES, LLP; Roger L. Browdy; James E. Mrose

(57) ABSTRACT

The present invention, provides a foldable wall bed/sofa (100) comprising: a pivotable bed frame (102), a foldable sofa frame (108), a connector (116) for connecting said foldable sofa frame (108) to said bed frame (102), a sofa retracting mechanism comprising a sofa locking device (118A, B) for keeping said foldable sofa frame (108) folded when rotating said bed frame (102) to vertical/horizontal positions, and a bed retracting mechanism (106) comprising a bed locking device (120) for keeping said bed frame (102) fixed in vertical position. Said foldable wall bed/sofa (100) configurable to at least, one of: (a) said bed frame (102) maintained in a horizontal position with said sofa frame (108) folded and positioned underneath the lower surface of said bed frame (102); (b) said bed frame (102) maintained in a vertical position where said sofa frame (108) is folded and positioned adjacent, to the lower surface of said bed frame (102); (c) said bed frame (102) maintained in a vertical position where said sofa frame (108) is unfolded in a horizontal position.

17 Claims, 14 Drawing Sheets

(56) References Cited

U.S. PATENT DOCUMENTS

| | | | | | |
|---|---|---|---|---|---|
| 2,634,433 | A * | 4/1953 | Woller | A47C 17/50 | 5/9.1 |
| 4,103,373 | A * | 8/1978 | Luedtke | A47C 17/50 | 5/147 |
| 4,589,152 | A * | 5/1986 | Pakosh | A47C 17/40 | 5/164.1 |
| 5,136,737 | A * | 8/1992 | Reppas | A47C 17/04 | 5/162 |
| 8,299,679 | B2 | 10/2012 | Chommeloux et al. | | |
| 8,898,831 | B1 * | 12/2014 | Burchett | A47C 17/52 | 5/164.1 |
| 9,211,016 | B2 * | 12/2015 | Guyvoronskiy | A47C 17/48 | |
| 10,085,567 | B1 * | 10/2018 | Reyes | A47C 23/06 | |
| 2003/0121099 | A1 * | 7/2003 | Lim | A47C 17/20 | 5/136 |
| 2021/0037983 | A1 * | 2/2021 | Marjadsingh | A47C 17/165 | |

* cited by examiner

FOLDABLE WALL BED/SOFA

FIELD OF THE INVENTION

The present invention relates to multifunctional furniture. More specifically, the present invention relates to multifunctional foldable furniture.

BACKGROUND OF THE INVENTION

When searching for a space-saving sleeping solution, more and more people think of multi-functional furniture and choose sofa beds. Sofa beds do offer two-for-one in functionality, however, they are usually difficult to unfold and uncomfortable.

An alternative option would be a foldable wall bed/sofa, and there are various types of foldable wall bed/sofa sets suitable for small-sized living rooms, wall bed/sofa sets which are different in size, structure and design.

An aim of the present invention is to provide a cost competitive foldable wall bed/sofa that is safe, convenient, comfortable to use, suitable for all ages and most importantly compact and space saving.

SUMMARY OF THE INVENTION

Foldable wall bed/sofa of the present invention is highly advantageous over the various foldable wall bed/sofa available nowadays mainly with regard to space saving considerations. The unique design of the foldable wall bed/sofa of the present invention is such that the sofa is foldable and is fixedly held adjacent to the bed. Thus, when both the bed and the sofa are not in use, the bed is maintained in a vertical position and the folded sofa is fixedly held adjacent to the bed. The space (depth) occupied by the vertically held bed and the folded sofa is about 70 centimeters altogether. Such compact, space saving design is enabled regardless of the depth of the sofa while in use (the sofa may have a standard depth or greater while in used) since it is fully folded when not in use.

Thus, in accordance with some embodiments of the present invention, there is provided a foldable wall bed/sofa comprising:

- a pivotable bed frame,
- a foldable sofa frame,
- a connector for connecting said foldable sofa frame to said bed frame,
- a sofa retracting mechanism comprising a sofa locking device for keeping said foldable sofa frame folded when rotating said bed frame to vertical/horizontal positions, and
- a bed retracting mechanism comprising a bed locking device for keeping said bed frame securely fixed while in vertical position,
  - wherein said foldable wall bed/sofa configurable to at least one of the following:
    - (a) said bed frame maintained in a horizontal position with said sofa frame folded and positioned underneath the lower surface of said bed frame;
    - (b) said bed frame maintained in a vertical position where said sofa frame is folded and positioned adjacent to the lower surface of said bed frame;
    - (c) said bed frame maintained in a vertical position where said sofa frame is unfolded in a horizontal position.

In accordance with some embodiments of the present invention, the foldable wall bed/sofa further comprising at least one of bed legs, a mattress, sofa legs, a sofa seat cushion, and a sofa backrest.

In accordance with some embodiments of the present invention, the connector connecting the lower surface of said bed frame to a section of said foldable sofa frame corresponding to the backrest.

In accordance with some embodiments of the present invention, the foldable wall bed/sofa further comprising sofa locking means connected to said connector.

In accordance with some embodiments of the present invention, the locking means comprised of a locking member and a protruding member for locking said sofa frame to said bed frame to maintain said sofa frame in position underneath and adjacent to said bed frame when said bed frame being rotated to vertical/horizontal positions.

In accordance with some embodiments of the present invention, the pivotable bed frame is pivotable between a horizontal position and a vertical position.

In accordance with some embodiments of the present invention, the sofa locking device is an "L" shaped connector.

In accordance with some embodiments of the present invention, the bed retracting mechanism is either an electrical or mechanical type mechanism.

In accordance with some embodiments of the present invention, the bed retracting mechanism comprises a hydraulic cylinder for rotating said bed frame by 0 to 90 degrees.

In accordance with some embodiments of the present invention, the bed retracting mechanism comprises a hydraulic cylinder for rotating said bed frame by 0 to 83 degrees.

In accordance with some embodiments of the present invention, the bed retracting mechanism comprises a sliding guide and a pin slidable along said sliding guide causing said bed frame to undergo a free fall of 6 to 10 degrees and preferably 7 degrees.

In accordance with some embodiments of the present invention, the bed locking device is comprised of an L-shaped bracket pivotally attachable to a base frame of said foldable wall bed/sofa.

In accordance with some embodiments of the present invention, the L-shaped bracket is tightened to said base frame, said bed frame is securely maintained in its vertical position.

In accordance with some embodiments of the present invention, the bed locking device is untightened to said base frame, said bed frame is free to rotate upwards or downwards.

In accordance with some embodiments of the present invention, the sofa retracting system comprising a hydraulic cylinder for rotating said sofa frame by 0 to 90 degrees.

In accordance with some embodiments of the present invention, the sofa retracting system comprising a hydraulic cylinder for rotating said sofa frame by 0 to 84 degrees.

In accordance with some embodiments of the present invention, the sofa retracting system comprises a push rod connected to a spring, said push rod attached to said sofa legs, wherein when said sofa frame is folded, said push rod does not reach said sofa frame, and thus, said sofa legs are kept folded, when said sofa frame is unfolded, push rod is pressed against said sofa frame as a result of which said spring pushes said sofa legs out to a vertical position.

In accordance with some embodiments of the present invention, the foldable wall bed is maintained in a vertical position and said sofa is folded, said foldable wall bed/sofa occupies a space (in depth) ranging between 65 and 75 centimeters.

In accordance with some embodiments of the present invention, the foldable wall bed is maintained in a vertical position and said sofa is folded, said foldable wall bed/sofa occupies a space (in depth) of 70 centimeters.

In accordance with some embodiments of the present invention, the bed has a standard bed height and the foldable sofa has a standard sofa height.

In accordance with some embodiments of the present invention, the bed stands on its own when disconnected from said sofa.

In accordance with some embodiments of the present invention, the sofa stands on its own when disconnected from said bed and attached to a vertical base.

DETAILED DESCRIPTION OF THE FIGURES

Figure 1A:
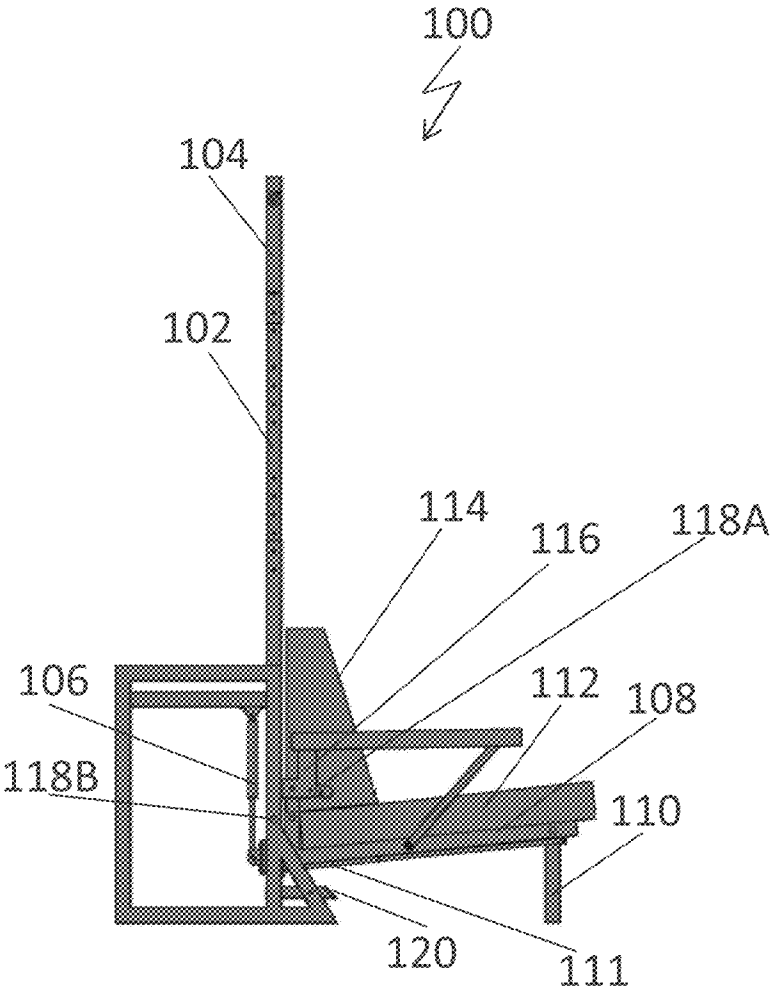
FIGS. 1A-C illustrate a foldable wall bed/sofa in accordance with some embodiments of the present invention.
Figure 1B:
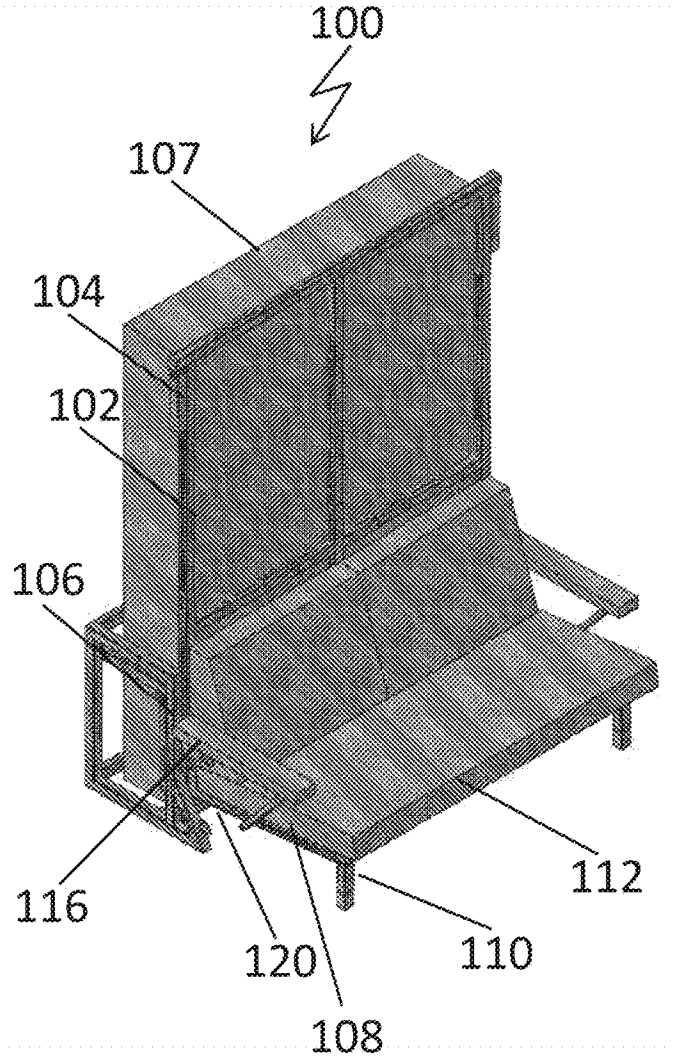
Figure 1C:
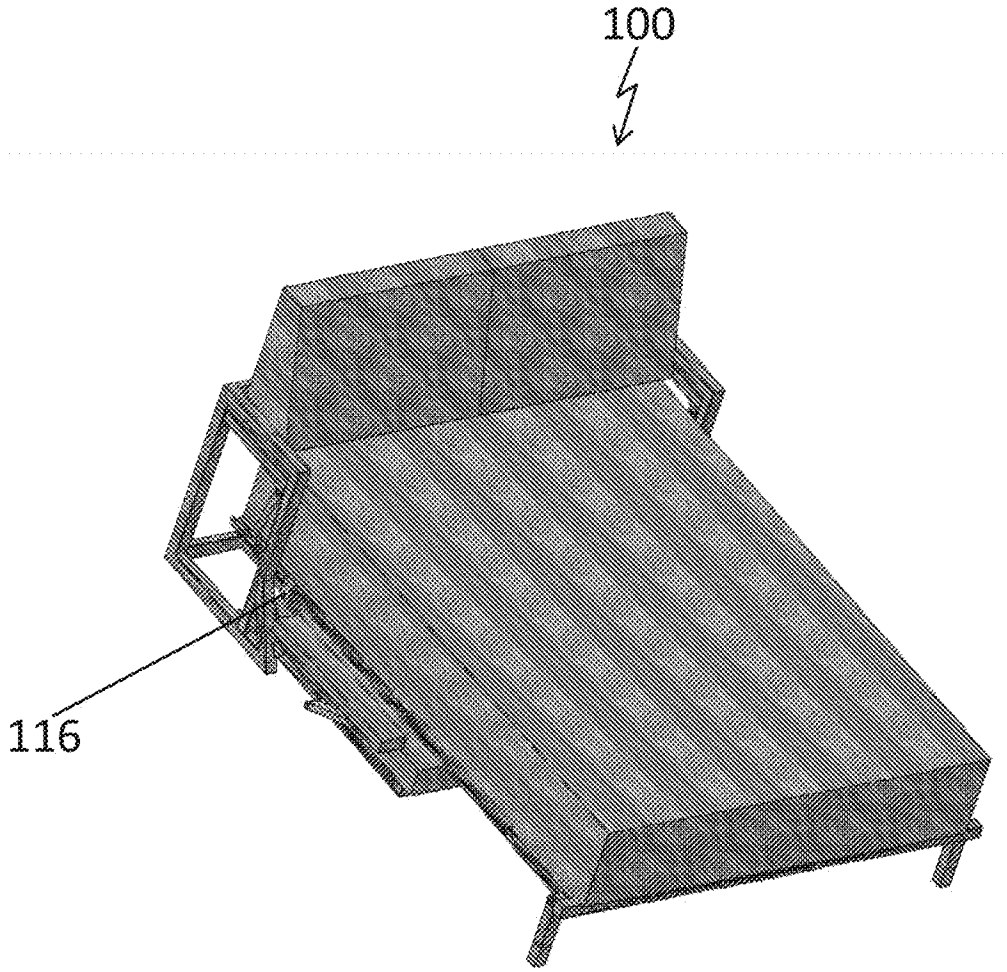

FIGS. 1A-C illustrate foldable wall bed/sofa 100 in accordance with some embodiments of the present invention. FIG. 1A is a side view of foldable wall bed/sofa 100 and FIGS. 1B&C are perspective views of foldable wall bed/sofa 100 with the bed maintained in vertical and horizontal positions respectively.

Seen in the figures, foldable wall bed/sofa 100 comprises a bed frame 102, bed legs 104, a bed retracting mechanism 106, a mattress 107, a sofa frame 108, sofa legs 110, a sofa retracting mechanisms 111, a sofa seat cushion 112, a sofa backrest 114, an 'L' shaped connector 116, sofa locking means 118A&B and a bed locking device 120.

In accordance with some embodiments of the present invention, bed frame 102 is mounted to be pivotable between a horizontal use position and a vertical position adjacent to a wall or inside a wall or a cabinet. In accordance with some embodiments of the present invention, when bed frame 102 is maintained in a vertical position adjacent to the wall, sofa frame 108 may be in an unfolded vertical position that allows people to sit and rest as seen in FIGS. 1A and 1B.

In accordance with some embodiments of the present invention, when bed frame 102 is pulled outward to its horizontal position, sofa frame 108 folds and the sofa as a whole settles below bed frame 102 in such a way that the lower surface of bed frame 102 rests on sofa backrest 114 as seen in FIG. 1C. Seen in FIGS. 1A-C, 'L' shaped connector 116 connects sofa frame 108 to bed frame 102 in such a way that the sofa a whole, e.g., foldable sofa frame 108, sofa seat cushion 112 and sofa backrest 114, is kept folded underneath bed frame 102 when bed frame 102 is in a horizontal use position. Such configuration in which the sofa as a whole is folded and kept underneath bed frame 102 is highly advantageous since it allows using a bed and a sofa having standard bed and sofa heights.

Sofa locking means 118A&B, comprised of locking member 118A and protruding member H 8B, lock sofa frame 108 to bed frame 102 to allow the rotation of bed frame 102 to vertical/horizontal positions with sofa frame 108 fixedly attached to bed frame 102. As seen in the figure, when sofa frame 108 is folded, sofa locking member 118A is fixedly attached to protruding element 118B to maintain sofa frame 108 folded and in position underneath and adjacent to bed frame 102.

In accordance with some embodiments of the present invention, bed legs 104 are hingedly mounted on bed frame 102, and sofa legs 110 are hingedly mounted on sofa frame 108.

In accordance with some embodiments of the present invention, both the bed and the sofa may stand on their own. 'L' shaped connector 116 may be disconnected to dismantle foldable wall bed/sofa 100.

Figure 2A:
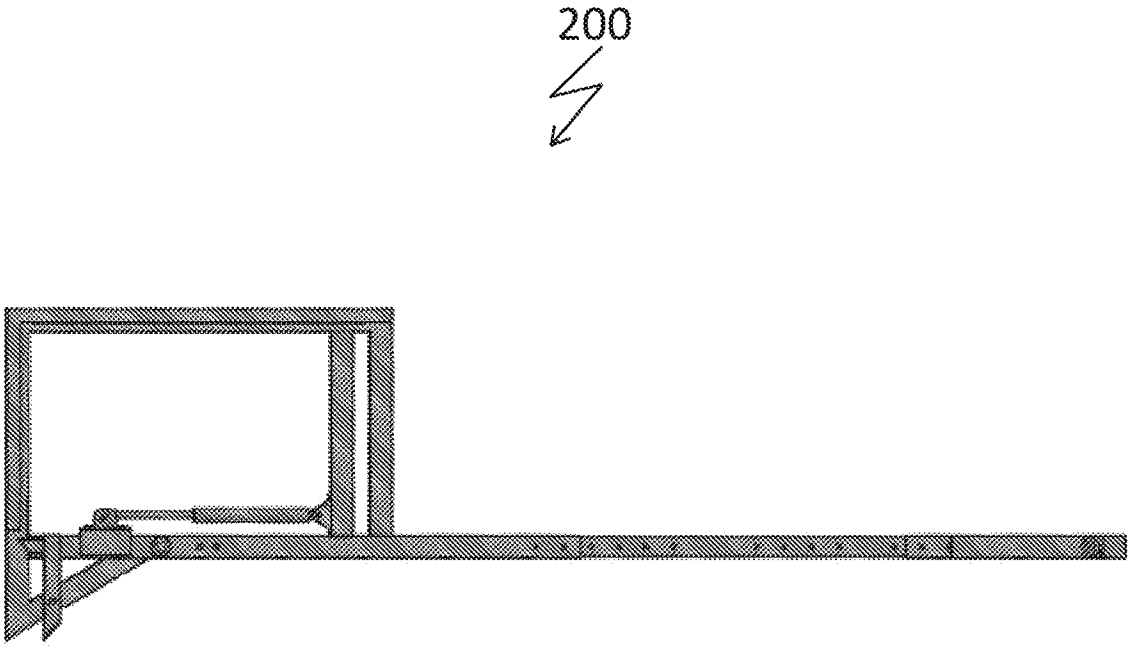
FIG. 2 is a side view of the sofa frame connected to a vertical base in accordance with some embodiments of the present invention.
Figure 2B:
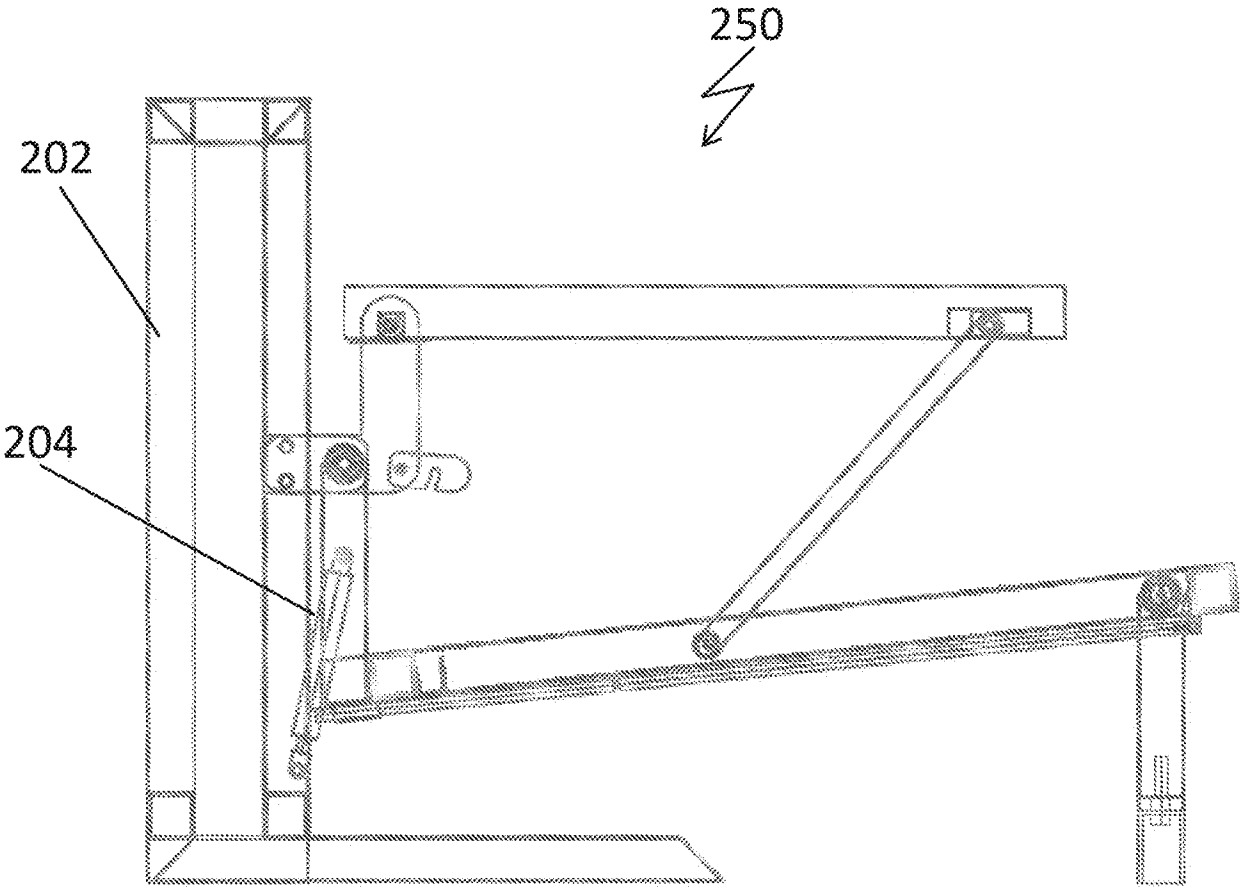

FIG. 2A is a side view of bed frame 102, and FIG. 2B is a side view of sofa frame 108 connected to a vertical base 202.

As seen in FIG. 2A, bed frame 102 may stand on its own while sofa frame 108 may be connected to a vertical base seen in FIG. 2B in order to stand on its own.

Seen in the figure is the sofa retracting mechanism 111 mounted on the side of sofa frame 204. In accordance with some embodiments of the present invention, sofa retracting mechanism 111 is used whether the sofa is connected to bed frame 102 seen in FIGS. 1A&B or to vertical base 202 seen in FIG. 2.

Figure 3A:
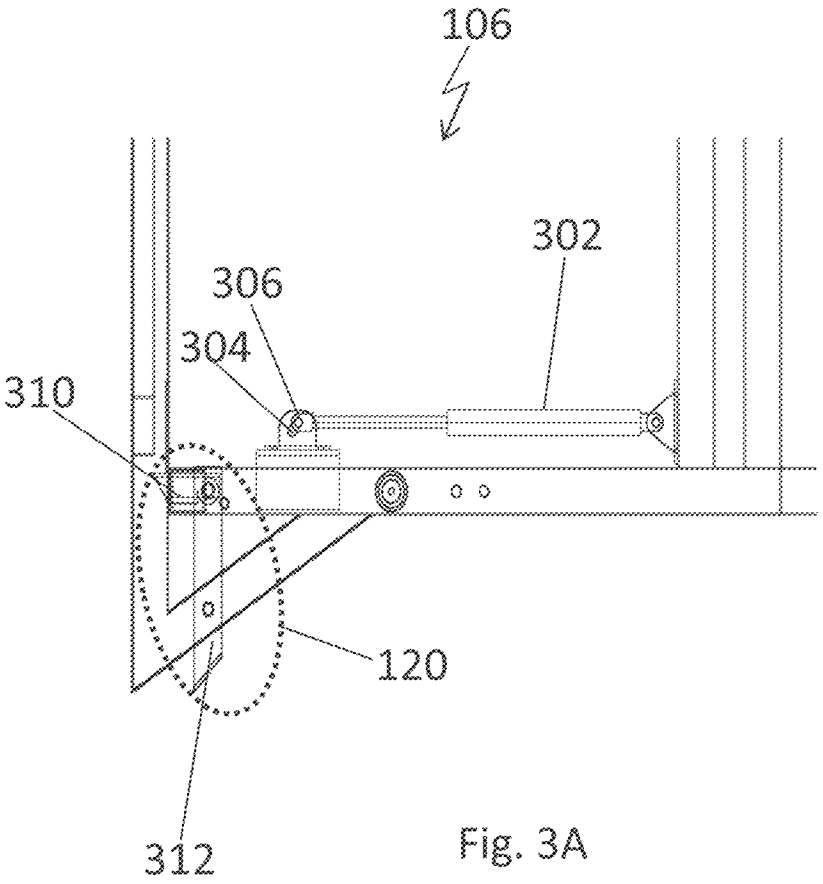
FIGS. 3A&B illustrate a bed locking device in accordance with some embodiments of the present invention.

FIGS. 3A&B illustrate a magnified side view of bed retracting mechanism 106 in accordance with some embodiments of the present invention.

Seen in the figures, bed retracting mechanism 106 comprises a sliding guide 304 and a pin 306 slidable along sliding guide 304 causing bed frame 102 to undergo a free fall of about 7 degrees. In addition, bed retracting mechanism 106 further comprises a hydraulic cylinder 302 with hydraulic pressure for rotating bed frame 102 to vertical/horizontal positions.

In accordance with some embodiments of the present invention, bed retracting mechanism 106 may be either mechanical or electrical.

FIGS. 3A&B further illustrate a bed locking device 120. Bed locking device 120 comprises a locking mechanism 310 and a locking arm 312 for locking bed frame 102 at its vertical position.

In FIG. 3A, bed locking device 120 is locked, pin 306 is in its upper position, and thus, bed frame 102 is fixedly held at its vertical position.

Figure 3B:
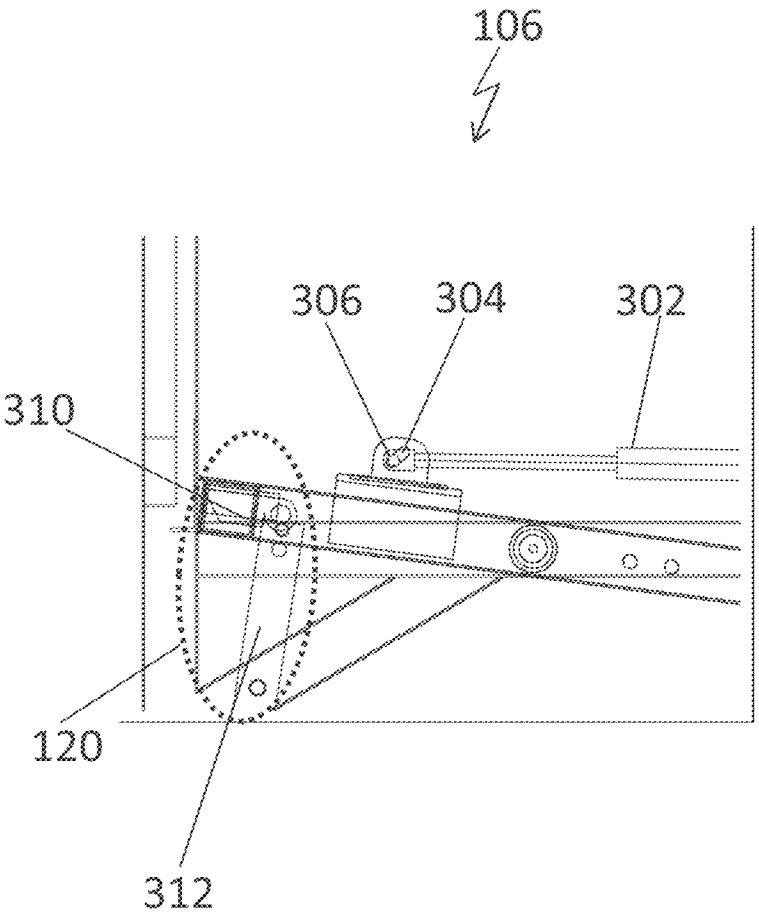

In FIG. 3B, bed locking device 120 is unlocked, pin 306 is in its lower position (after sliding along sliding guide 304, and bed frame 102 is inclined by about 7 degrees after undergoing a free fall. Such inclined position of bed frame 102 enables the user to pull the bed all the way down to it vertical position easily.

Figure 4:
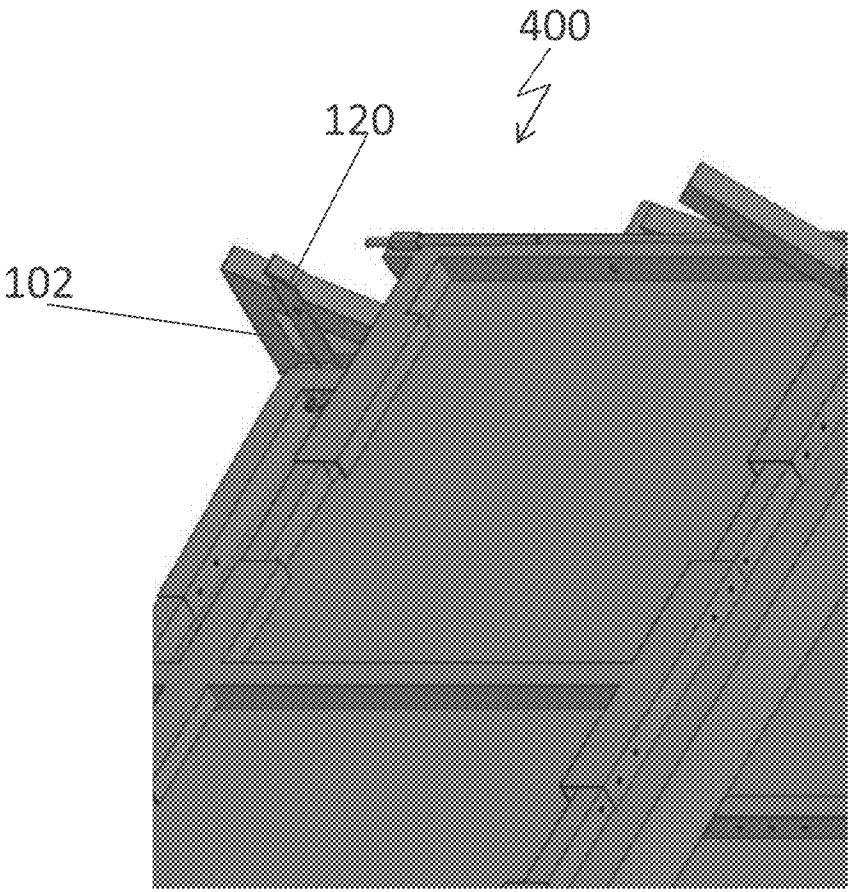
FIG. 4 is a side view of a base frame of the foldable wall bed/sofa of the present invention.

FIG. 4 is a side view of a base frame 400 of foldable wall bed/sofa 100 in accordance with some embodiments of the present invention.

Seen in the figure is locking arm 312 comprised of an L-shaped bracket with a lower vertical member and an upper tightening horizontal member. Bed locking device 120 is pivotally attachable to base frame 400 of the foldable wall bed/sofa 100. Locking device 120 is used to maintain bed frame 102 fixable in its position, i.e., to prevent bed frame 102 from pivoting towards the vertical/horizontal positions. When bed locking device 120 is locked, locking arm 312 is tightened to base frame 400, and thus, bed frame 102 is securely maintained in its position, either vertical or horizontal position. When bed locking device 120 is unlocked, bed frame 102 is free to rotate either upwards or downwards.

In accordance with some embodiments of the present invention, bed locking device 120 is mounted on each side of bed frame 102 and connected to each other via cables, thus, when one bed locking device 120 is locked/unlocked, the other one is locked/unlocked as well. Both bed locking devices 120 are mounted on bed frame 102 at a height entailing the user to reach locking arm 312 conveniently without the need to lean.

When bed frame 102 is in a vertical position adjacent to a wall, and a user untightens bed locking device 120, i.e., pushes bed locking device 120 upwards, pin 306 slides through sliding guide 304 causing bed frame 102 to undergo a free fall of about 7 degrees. Such free fall of bed frame 102 enables the user to pull the bed all the way down to its vertical position easily. Pulling bed frame 102 all the way down to a horizontal position is enabled by hydraulic cylinder 302 which rotates bed frame 102 by 0 to 90 degrees, and preferably by 0 to 83 degrees i.e., the reciprocating motion of the piston of the cylinder moves the bed frame 102 up and down.

Figure 5:
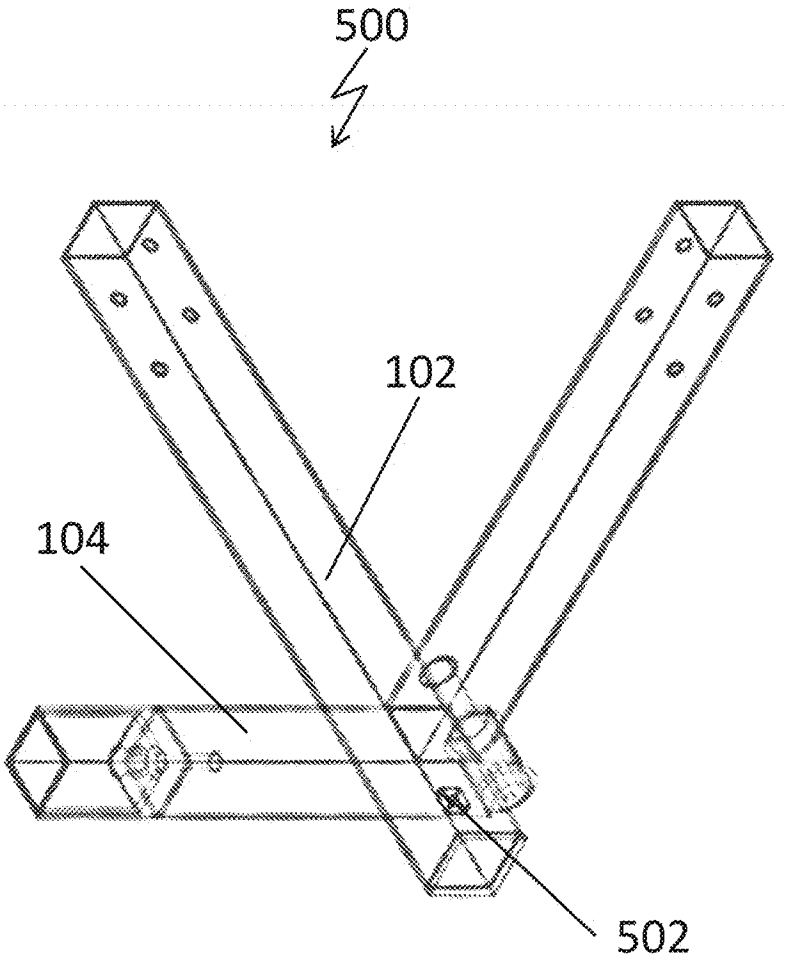
FIG. 5 illustrates pail of the bed frame accordance with some embodiments of the present invention.

FIG. 5 illustrates part of bed frame 102 including bed leg 104 and the magnetic element 502 attached to the bed frame 102 on the axis of each one of the bed legs 104. When the bed frame 102 is pulled down towards a horizontal position, bed legs 104 are released and being pulled down via magnetic element 502 to fully open bed legs 104 to form 90 degrees with the ground.

Figure 6A:
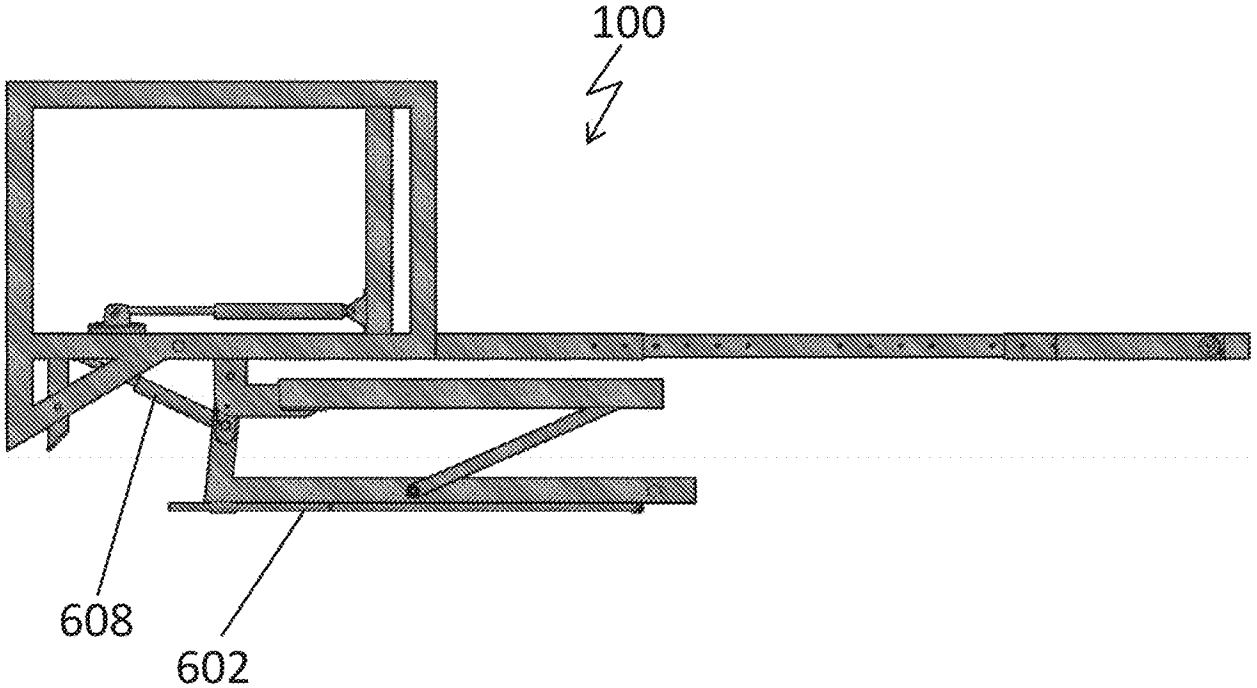
FIG. 6A is a side view of the wall bed/sofa in accordance with some embodiments of the present invention.
Figure 6B:
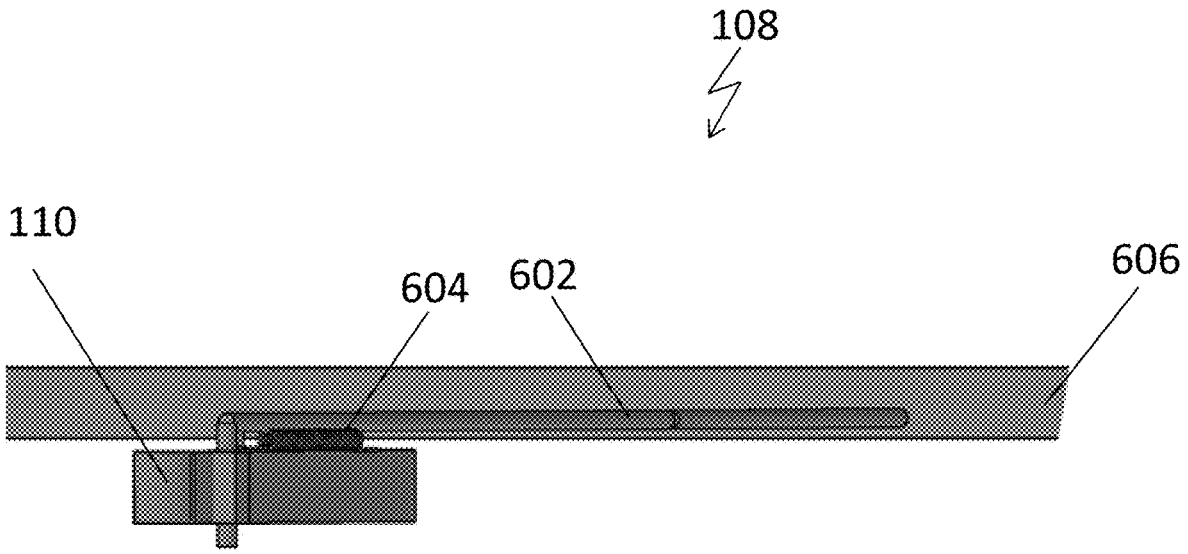
FIG. 6B is a bottom view of the sofa frame in accordance with some embodiments of the present invention.

FIG. 6A is a side view of wall bed/sofa 100 and FIG. 6B is a bottom view of sofa frame 108 in accordance with some embodiments of the present invention. As seen in the figures, sofa legs 110 are hingedly mounted on sofa frame 108, and sofa retracting mechanism 111 is mounted underneath and on the side of sofa frame 108.

Sofa retracting mechanism 111 comprises a push rod 602 and a spring 604 in accordance with some embodiments of the present invention.

Sofa legs 110 are attached to push rod 602 which is connected to spring 604. As seen in the figure, when sofa 600 is folded, push rod 602 does not reach bar 606 of sofa frame 108, and sofa legs 110 are kept folded. However, upon unfolding the sofa 600, push rod 602 is pressed against bar 606 as a result of which spring 604 pushes sofa legs 110 out to a vertical position.

As seen in FIG. 6A, sofa retracting mechanism 111 further comprises a hydraulic cylinder 608 which rotates sofa frame 108 by 0 to 90 degrees, and preferably by 0 to 84 degrees, i.e., the reciprocating motion of the piston of the cylinder moves the sofa frame 108 up and down. The sofa at the horizontal state is inclined in 3-9 degrees, preferably at 6 degrees.

FIGS. 7A-F are side and perspective views of foldable wall bed/sofa 100 showing a successive passage of bed/sofa 100 from a position in which bed frame 102 is in a vertical position to a position in which the bed frame 102 is in a horizontal position parallel to the floor.

Figure 7B:
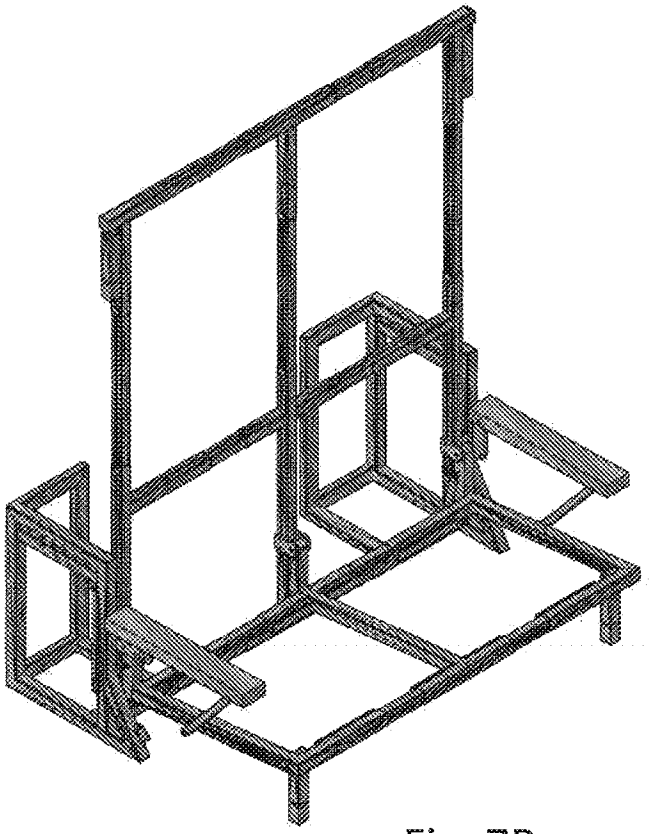
FIGS. 7A-F are side and perspective views of the foldable wall bed/sofa in accordance with some embodiments of the present invention.
Figure 7A:
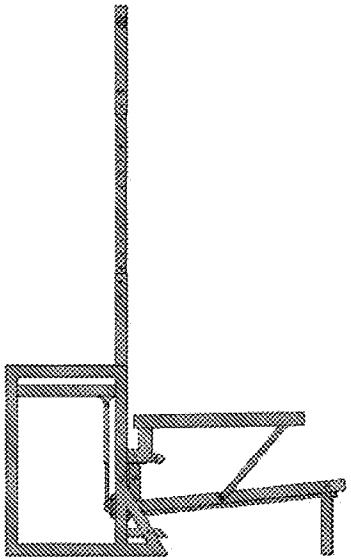
Figure 7D:
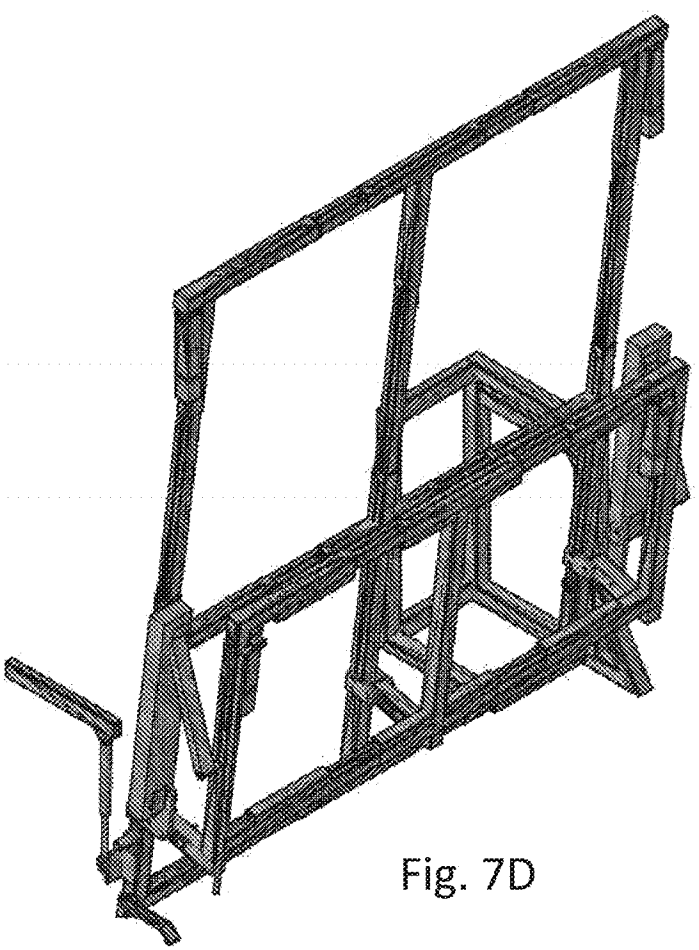

In FIGS. 7A&B, bed frame 102 is maintained in a vertical position adjacent to the wall, and the sofa frame 108 is in an unfolded vertical position that allows people to sit and rest.

Figure 7C:
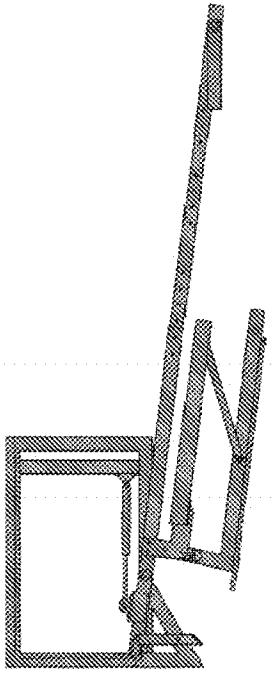

In FIGS. 7C&D, bed frame 102 is inclined by about 7 degrees. As noted earlier, bed frame 102 undergoes a free fall of about 7 degrees when bed locking device 120 is released and pin 306 slides through sliding guide 304.

Figure 7E:
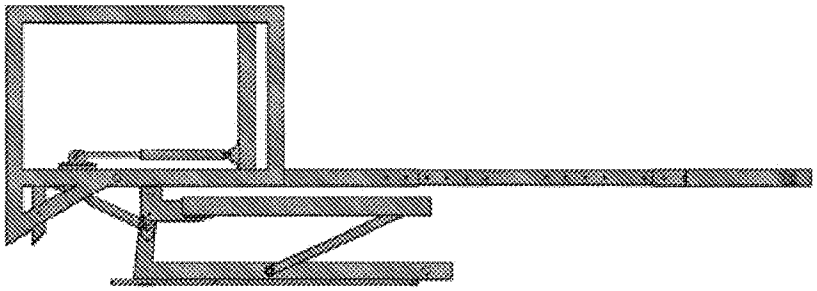
Figure 7F:
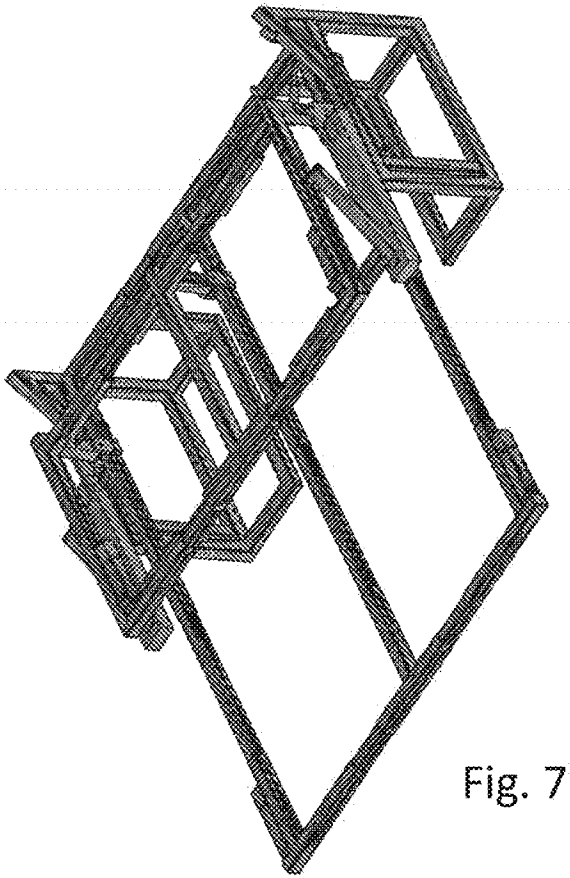

In FIGS. 7E&F, bed frame 102 is in a horizontal position parallel to the ground, and sofa frame 108 is folded and settled below the bed frame 102. As noted earlier, when bed locking device 120 is released, pin 306 slides through sliding guide 304, and bed frame 102 undergoes a free fall of about 7 degrees. After the free fall of bed/sofa 100, the user can pull out the bed all the way down to its horizontal position.

As seen in the figures, and mainly in FIGS. 7E&F, when bed frame 102 is in a horizontal position, sofa frame 108 is folded and settled below bed frame 102. Such design is highly advantageous as the width of the folded sofa does not influence the height of the bed and mattress. More, specifically, such design enables using the standard height of a bed and mattress from the floor which is suitable for all ages. The standard height of the sofa is higher than the standard height of a bed, especially for older people, to enable easy use when rising up from the surface. The special design of this invention and folding mechanism, especially the folding legs enable this height differences.

It should be noted that bed frame 102 can be extended/retracted telescopically.

It should be further noted that foldable wall bed/sofa 100 may include various types of beds including an adjustable bed.

The invention claimed is:

1. A foldable wall bed/sofa comprising:

a pivotable bed frame, a foldable sofa frame, a connector for connecting said foldable sofa frame to said bed frame, a sofa retracting mechanism comprising a sofa locking device for keeping said foldable sofa frame folded when rotating said bed frame between a vertical position of the bed frame and a horizontal position of the bed frame, and a bed retracting mechanism comprising a bed locking device for keeping said bed frame securely fixed while in the vertical position of the bed frame, wherein said foldable wall bed/sofa is configurable to allow all of the following states:

(a) said bed frame maintained in the horizontal position of the bed frame with said sofa frame folded and positioned underneath the lower surface of said bed frame;

(b) said bed frame maintained in the vertical position of the bed frame where said sofa frame is folded and positioned adjacent to the lower surface of said bed frame;

(c) said bed frame maintained in the vertical position of the bed frame where said sofa frame is unfolded in a horizontal position of the sofa frame;

wherein said connector connects the lower surface of said bed frame to a section of said foldable sofa frame corresponding to a sofa backrest;

wherein said bed locking device is comprised of an L-shaped bracket pivotally attachable to a base frame of said foldable wall bed/sofa;

wherein said bed retracting mechanism further comprises a sliding guide and a pin slidable along said sliding guide causing said bed frame to undergo a free fall of approximately 6 to 10 degrees relative to the vertical position of the bed frame.

2. The foldable wall bed/sofa of claim 1, wherein said foldable wall bed/sofa further comprises at least one of bed legs, a mattress, sofa legs, and a sofa seat cushion.

3. The foldable wall bed/sofa of claim 1, wherein the sofa locking device is connected to said connector.

4. The foldable wall bed/sofa of claim 3 wherein said sofa locking device comprises a locking member and a protruding member for locking said sofa frame to said bed frame to maintain said sofa frame in position underneath and adjacent to said bed frame when said bed frame being rotated between the vertical position of the bed frame and the horizontal position of the bed frame.

5. The foldable wall bed/sofa of claim 1, wherein said pivotable bed frame is pivotable between the horizontal position of the bed frame and the vertical position of the bed frame.

6. The foldable wall bed/sofa of claim 1, wherein said sofa locking device is an "L" shaped connector.

7. The foldable wall bed/sofa of claim 1, wherein said bed retracting mechanism is either an electrical or mechanical mechanism.

8. The foldable wall bed/sofa of claim 1, wherein said bed retracting mechanism comprises a hydraulic cylinder for rotating said bed frame by 0 to 90 degrees.

9. The foldable wall bed/sofa of claim 1, wherein said bed retracting mechanism comprises a hydraulic cylinder for rotating said bed frame by 0 to 83 degrees.

10. The foldable wall bed/sofa of claim 1, wherein said free fall is approximately 7 degrees.

11. The foldable wall bed/sofa of claim 1, wherein when said L-shaped bracket is tightened to said base frame, said bed frame is securely maintained in the vertical position of the bed frame.

12. The foldable wall bed/sofa of claim 1, wherein when said bed locking device is untightened to said base frame, said bed frame is free to rotate upwards or downwards.

13. The foldable wall bed/sofa of claim 1, wherein said sofa retracting system comprises a hydraulic cylinder for rotating said sofa frame by 0 to 90 degrees.

14. The foldable wall bed/sofa of claim 1, wherein said sofa retracting system comprising a hydraulic cylinder for rotating said sofa frame by 0 to 84 degrees.

15. The foldable wall bed/sofa of claim 1, wherein said bed has a standard bed height, and said foldable sofa has a standard sofa height.

16. The foldable wall bed/sofa of claim 1, wherein said bed stands on its own when disconnected from said sofa.

17. The foldable wall bed/sofa of claim 1, wherein said sofa stands on its own when disconnected from said bed and attached to a vertical base.

* * * * *